US009850734B2

(12) United States Patent
Wee

(10) Patent No.: US 9,850,734 B2
(45) Date of Patent: Dec. 26, 2017

(54) PLUG FOR INSTALLATION IN A WELL

(71) Applicant: Plugtech AS, Haugesund (NO)

(72) Inventor: Gustav Wee, Haugesund (NO)

(73) Assignee: Plugtech AS, Haugesund (NO)

( * ) Notice: Subject to any disclaimer, the term of this patent is extended or adjusted under 35 U.S.C. 154(b) by 182 days.

(21) Appl. No.: 14/414,316

(22) PCT Filed: Jul. 23, 2013

(86) PCT No.: PCT/NO2013/000039
§ 371 (c)(1),
(2) Date: Jan. 12, 2015

(87) PCT Pub. No.: WO2014/017921
PCT Pub. Date: Jan. 30, 2014

(65) Prior Publication Data

US 2015/0211321 A1 Jul. 30, 2015

(30) Foreign Application Priority Data

Jul. 23, 2012 (NO) ..... 20120843

(51) Int. Cl.
*E21B 33/12* (2006.01)

(52) U.S. Cl.
CPC ..... *E21B 33/12* (2013.01); *E21B 33/1208* (2013.01)

(58) Field of Classification Search
CPC ..... E21B 33/12; E21B 33/1208
USPC ..... 166/192
See application file for complete search history.

(56) References Cited

U.S. PATENT DOCUMENTS 3,989,057 A * 11/1976 Muddiman ..... F16K 17/1626 137/68.24
4,886,127 A 12/1989 Ricles et al.
5,479,986 A * 1/1996 Gano ..... E21B 23/00 166/192
5,607,017 A 3/1997 Owens et al.
5,632,348 A 5/1997 Yunan
5,680,905 A 10/1997 Green et al.
5,765,641 A 6/1998 Shy et al.
6,076,600 A 6/2000 Vick, Jr. et al.
6,161,622 A 12/2000 Robb et al.
6,220,350 B1 4/2001 Brothers et al.
6,334,488 B1 * 1/2002 Freiheit ..... E21B 34/10 166/142
6,431,276 B1 8/2002 Robb et al.
6,472,068 B1 10/2002 Glass et al.
(Continued)

FOREIGN PATENT DOCUMENTS

NO 321974 B1 7/2006
NO 321976 B1 7/2006
(Continued)

OTHER PUBLICATIONS

Løvås, Bjørn, "International Search Report," prepared for PCT/NO2013/000039, dated Oct. 15, 2013, three pages.

*Primary Examiner* — David J Bagnell
*Assistant Examiner* — Jonathan Malikasim
(74) *Attorney, Agent, or Firm* — Winstead PC

(57) ABSTRACT

A plug for installation in a well, comprising a housing (2) that carries at least two discs (3, 4) of a brittle material that can be fractured by mechanical forces and with a core between the discs (3, 4). The core comprises particulate material in compact form.

6 Claims, 2 Drawing Sheets

(56) References Cited

U.S. PATENT DOCUMENTS

| | | | | |
|---|---|---|---|---|
| 6,619,388 | B2 * | 9/2003 | Dietz | E21B 34/066 166/332.8 |
| 7,044,230 | B2 | 5/2006 | Starr et al. | |
| 7,093,664 | B2 | 8/2006 | Todd et al. | |
| 7,168,494 | B2 | 1/2007 | Starr et al. | |
| 7,325,617 | B2 | 2/2008 | Murray | |
| 8,220,538 | B2 | 7/2012 | Wee | |
| 8,322,448 | B2 * | 12/2012 | Brandsdal | E21B 33/12 166/164 |
| 2003/0168214 | A1 | 9/2003 | Sollesnes | |
| 2007/0017676 | A1 | 1/2007 | Reddy et al. | |
| 2010/0270031 | A1 * | 10/2010 | Patel | E21B 33/1208 166/376 |
| 2011/0277988 | A1 * | 11/2011 | Wee | E21B 33/1208 166/192 |

FOREIGN PATENT DOCUMENTS

| | | | | |
|---|---|---|---|---|
| NO | 322871 | B1 | 12/2006 | |
| NO | 325431 | B1 | 4/2008 | |
| NO | 329980 | B1 | 1/2011 | |
| WO | WO-2007108701 | A1 | 9/2007 | |
| WO | WO-2009110805 | A1 | 9/2009 | |
| WO | WO2009116871 | * | 9/2009 | E21B 33/12 |
| WO | WO-2009116871 | A1 | 9/2009 | |
| WO | WO-2010090529 | A2 | 8/2010 | |

* cited by examiner

PLUG FOR INSTALLATION IN A WELL

The present invention relates to a plug for temporary installation in a well, in particular for use in pressure testing of the well.

These types of plugs are typically installed when the well shall be pressure tested, for example, before production from the well has been initiated or after comprehensive maintenance of the well has been carried out. When the plug is installed it is possible to put a pressure on a part of the well and check that valves, pipe joints, gaskets, etc., are leak proof. After the pressure testing has been carried out and the production shall be started, the plug must be removed. It can be difficult or often impossible to retrieve the plug up again to the surface, therefore, plugs are developed that can be destroyed after they have been used. The remains of the plug are then brought out of the well with the flow from the well. Today there are several types of plugs that are intended to be removed by destruction. A destructible plug was developed in Egypt as early as in the 1980's. It was installed in more than 800 wells.

The known destructible plugs can be destroyed in several ways. Some types of plugs will be dissolved after a certain time in contact with the well fluid, while others are destroyed with the help of explosives. The latter types of plugs are often made from glass, and examples of these have been given in NO 321974, NO 322871 and NO 321976.

Also known is a plug from NO 325431 (that corresponds to WO2007/108701) where the plug is broken in that a valve is reset to drain the fluid between the glass discs. When the pressure between the glass discs is reduced, the glass discs will not stand up to the pressure on the top side of the plug and thereby break up.

US 2010/270031 describes a plug where reference is made to different plug materials which, when activated, are exposed to a fluid, which thereby sets in motion a reaction or dissolution/degradation process, which in turn ensures that the plug loses its mechanical strength and breaks up. Although it is stated that the plug material can be porous, the material must be of a "solid" consistency according to its construction (such as sandstone is solid but still porous) before the degradation process starts to be able to hold the pressure difference across the plug. The dissolution of the plug will therefore take time and it will be uncertain when the dissolution has come so far that the plug can no longer resist the pressure.

Other destructible plugs of different types are known from: U.S. Pat. No. 4,886,127, U.S. Pat. No. 5,607,017, U.S. Pat. No. 5,479,986, U.S. Pat. No. 5,607,017, U.S. Pat. No. 5,765,641, U.S. Pat. No. 5,632,348, U.S. Pat. No. 5,680,905, U.S. Pat. No. 6,076,600, U.S. Pat. No. 6,161,622, U.S. Pat. No. 6,431,276, U.S. Pat. No. 6,220,350, U.S. Pat. No. 6,472,068, U.S. Pat. No. 7,044,230, U.S. Pat. No. 7,093,664, U.S. Pat. No. 7,168,494, U.S. Pat. No. 7,325,617, US2003/0168214 and US2007/0017676 and WO 2009/110805.

The known plugs all have different disadvantages. The soluble plugs will disappear only after the well fluid has worked for a while on the soluble material. Therefore it is not possible to ascertain with a degree of predictability when the plug will stop to seal. This can in the best case delay the start-up of the production and in the worst case the plug can lose its function before the pressure testing is completed. To avoid the latter, the plug will normally be constructed so that it takes a relatively long time before it is dissolved.

Plugs that are destroyed with the help of explosives will, as a rule, be destroyed safely and at the point in time one wants. However, they are encumbered with risks. As explosives must be handled carefully, they require special deliveries and it is very difficult to have the plug sent across country borders, in particular in areas where there is strict control of weapons and explosives. Furthermore, people with specialist knowledge about explosives are required for the handling of the plugs. Although the risk is small, there will be some danger that explosives detonate and harm people and put the production installation at risk. In rare cases, there may be a risk that the explosives cause damage to the equipment down in the well.

The above mentioned plug, known from NO325431 aims to avoid the use of explosives. As mentioned above, the destruction occurs in that the pressure inside the plug is released with the help of a valve body so that the pressure difference between the external pressure (on the top side of the plug) and the internal pressure becomes higher than that which the glass discs of the plug can tolerate. The glass discs subsequently disintegrate.

Although it is also mentioned that the discs can be exposed to point loads in that pegs are arranged that are set up to be forced against the edge of the glass discs when the valve body is opened, this will require a relatively high pressure over the plug to ensure that the glass discs break down. This could vary somewhat according to how high this pressure must be and one must therefore increase the pressure over the plug until one is sure that it will disintegrate. This pressure increase takes some time and after the plug is destroyed the pressure wave will propagate down into the well and will potentially be able to damage the formation.

If the liquid between the glass discs should not drain out, for example, as a consequence of the valve body not opening, the plug will not be destroyed even if the pressure over the plug is increased to a very high level. Then, one must go down with tools or explosives to destroy the plug.

It is also possible that the glass discs will not disintegrate into small fragments, but will leave large pieces that can be difficult to remove with the well stream.

From NO 329980, a plug is known that carries two discs of a brittle material that will crush under mechanical influences. Between the discs there is a gas filled hollow space connected to a drainage channel. A closing device is arranged to open to let the gas out from the hollow space. At least one lever or crow bar, which is set up to crush at least one of the discs, is arranged in the hollow space. A shear pin holds the discs some distance from each other, but is set up to be broken when the pressure difference across at least one of the discs exceeds a given value.

Even if this plug is much safer than earlier plugs, it is relatively complex to produce and a gas pressure must be established in the hollow space at a pressure that lies within relatively narrow limits.

The present invention aims for a predictable, reliable and accurate destruction of the plug, at the same time as the plug is safe to handle before its installation. It is also an aim to provide a plug that is relatively simple to manufacture and does not require special settings before use.

The plug shall now be described with reference to the enclosed figures, where:

FIG. 1 shows a plug assembly 1 that comprises a housing 2 which is set up to be connected together as an intermediate piece in a production pipe, or which is set up to be led into a production pipe and be fixed so that it seals the pipe.

Figure 1:
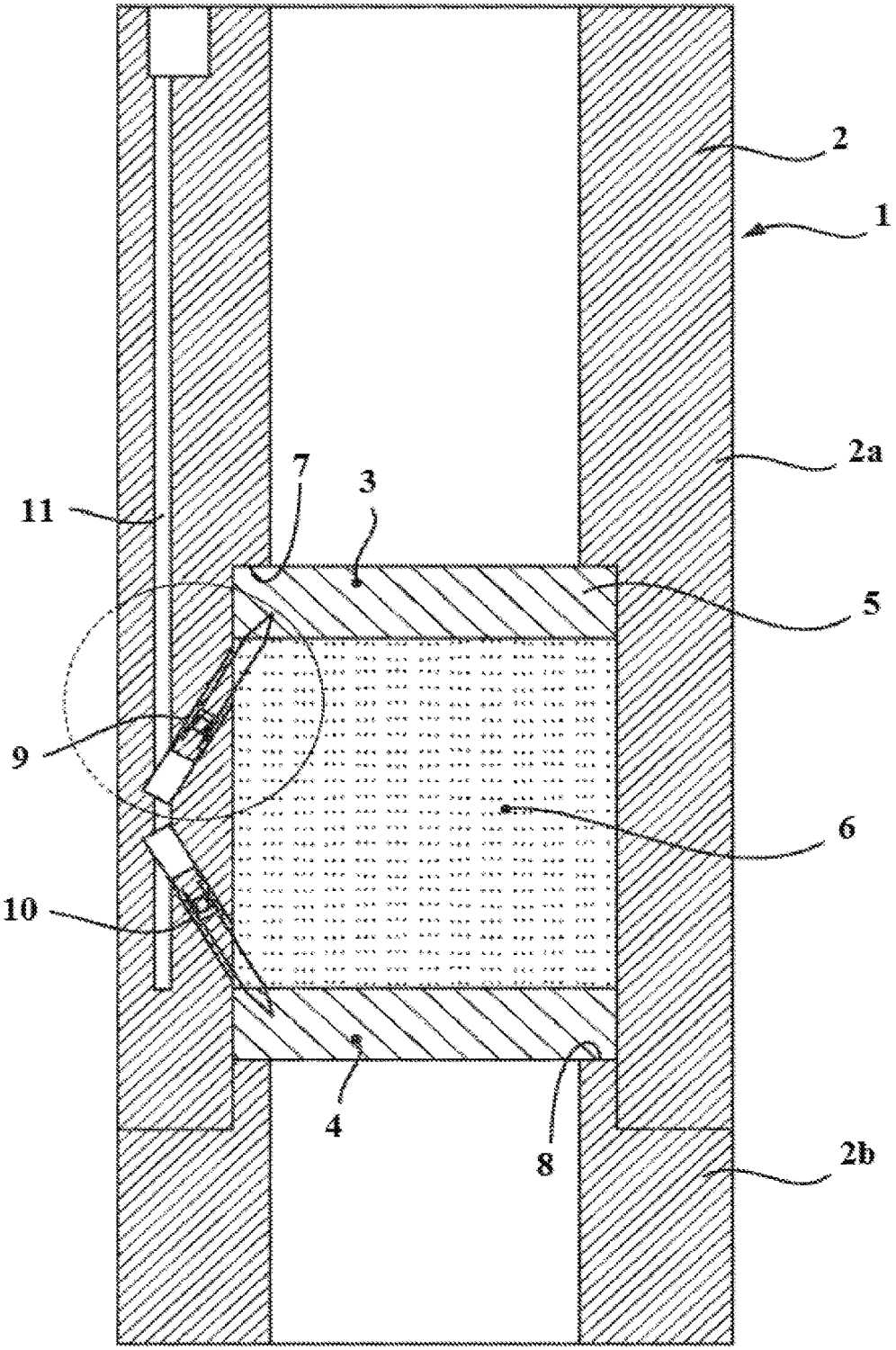
FIG. 1 shows a plug assembly according to the invention.

The plug 5 itself is arranged between two shoulders 7 and 8 in the housing 2. To be able to place the plug 5 in the housing 2, the housing is divided into an upper part 2*a* and a lower part 2*b*. These can, for example, be screwed together.

The plug 5 comprises an incompressible core 6 and two discs 3, 4 of a brittle material, for example, glass. The core 6 preferably consists of a particle-formed powder material, for example, sand, metal particles, glass beads or similar materials, where each particle is hard and incompressible.

Particle-formed materials have the property that if they are packed together in such a way that they take up the smallest volume possible, then the total amount of particles will behave like a solid material. In this state, the particles can not mutually move. This property is used, for example, in the construction of buildings in desert areas, where the sand below a certain depth is so compact that it can carry even some of the tallest skyscrapers in the world.

However, a such compact amount of particles will easily flow out if the particles are given an opportunity to move in relation to each other. Sand that is forced together in the bucket will, in this way, be able to carry an unlimited weight, but by turning the bucket upside down, one can empty the bucket as if it were water.

It is this dual property of the particle materials that is utilised in the present invention. The particle material is kept in between the wall of the housing 2 and the two discs 3, 4. One can appropriately turn the housing 2 on its head in relation to the orientation shown in FIG. 1, place the one disc 3 in the upper part 2*a* of the housing and fill with sand. To get the core 6 as compact as possible, one can shake the housing while it is filled with sand. When the sand has reached a level that just gives room for the disc 4, the filling ceases and the lower part 2*b* of the housing is screwed on. The lower part 2*b* of the housing is preferably in a position to push the disc 4 until it lies with a certain pressure against the core 6, so that there is no remaining hollow space in which the sand can move.

The core 6 together with the discs 3, 4 will behave as a compact and solid plug. The discs 3, 4 will have no room to move with respect to the core and can thereby withstand very high pressure differences. The incompressible nature of the plug material ensures that the pressure-carrying discs will not move with a varying pressure across the plug. In contrast to the plug in US 2010/270031, where the core takes up all the pressure, in the present invention it will be the combination of glass discs and powder core that takes up the pressure.

The core is preferably sealed to the surroundings so that liquid can not penetrate into the core. However, it is also possible to permit liquid to penetrate into the core 6 as long as the particle material can neither escape nor the particles can be mutually displaced.

Two release appliances 9, 10 are placed in the housing, one that works against the upper disc 3 and one that works against the lower disc 4. It is also possible to remove the plug with only one release appliance, but two provide a safer removal and redundancy. To increase the redundancy, it is also possible to have several release appliances around each of the discs.

A channel 11 is connected to both the release appliances 9, 10. The channel 11 can be pressurised by opening a valve (not shown) or by coupling to a hydraulic connection.

Figure 2:
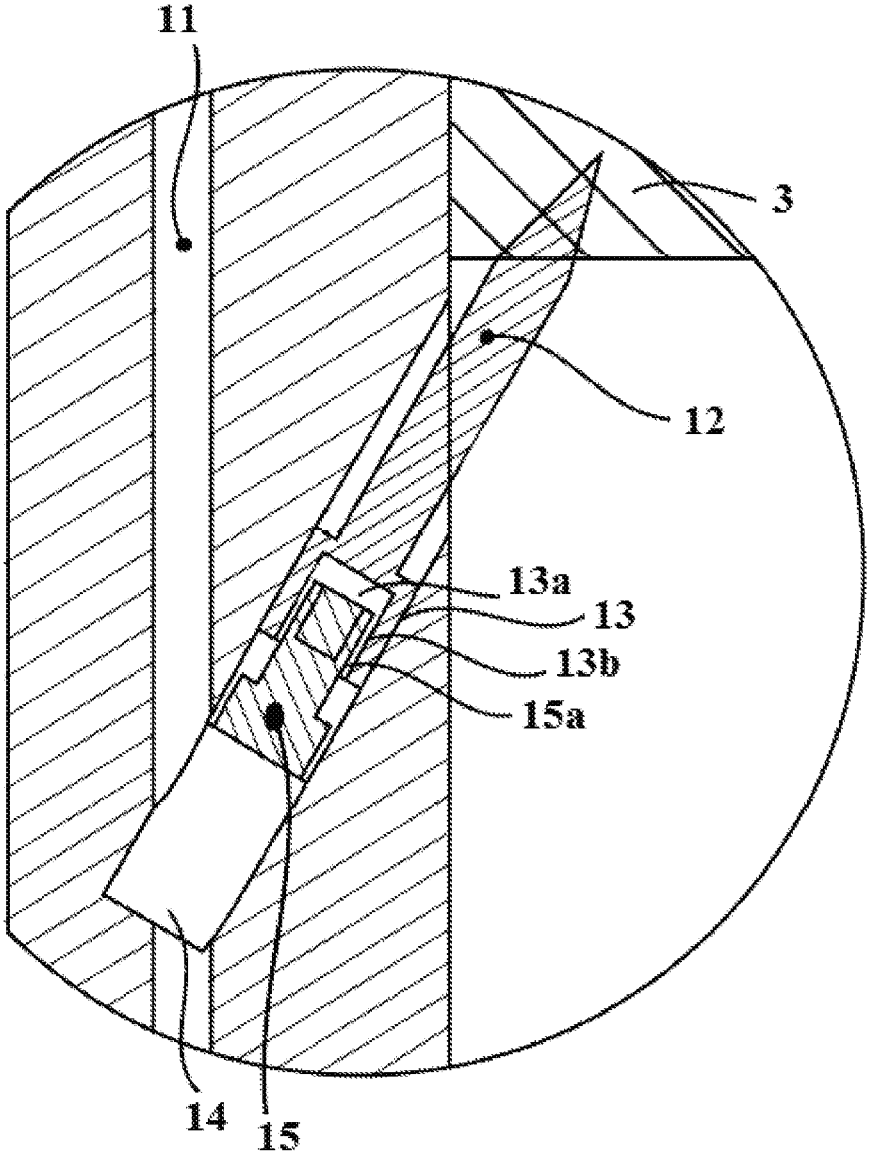
FIG. 2 shows in detail one of the two release appliances.

The release appliance is shown in detail in FIG. 2. It comprises a screw 12 that is arranged in a boring 14 and is pointed at its extreme end. The point is preferably hardened and when it is forced into the disc, it will create fissures that are spread further in the brittle disc until this breaks up into pieces.

The screw has a head 13 with a blind hole 13*a*. The blind hole 13*a* is fitted with threads 13*b*. A hydraulic piston 15 cooperates with the head 13 of the screw 12 and is fitted with threads 15*a* that engage with the threads 13*b*. The piston 15 cooperates with the boring 14 in such a way that the piston cannot rotate, for example, by cooperating rib and groove. When a hydraulic pressure is imposed onto the channel lithe piston 15 will be forced against the screw 12 and, due to the thread engagement between the piston 15 and the head of the screw 13, the screw will be forced against the disc 3 with simultaneous rotation. This will ensure that the screw penetrates into the disc and initiates the formation of the fissures in the disc.

The point of the screw 12 can preferably be shaped in the same way as self-tapping screws so that the screw 12 bores into the disc.

If the piston 15 reaches the bottom of the blind hole 13*a*, it will continue to force the screw against the disc 3. Therefore, it is possible to "pump" the screws into the discs 3, 4 by increasing the hydraulic pressure.

To increase the redundancy, one can also have two or more separate channels for the supply of hydraulic pressure.

The plug according to the invention will be able to tolerate that items are dropped unintentionally down in the hole. As the discs and the core form a compact, solid and massive unit, the discs will even be able to withstand the impact of large impact forces. The porous core will function as a dampener for the impact. If the upper disc should crush, the particle material in the core will absorb the rest of the energy from the impact and the other disc will therefore be able to withstand damage.

The plug can also withstand much higher pressures and temperatures than the plugs that are used today. One can choose a particle material that has a low coefficient of thermal expansion and which tolerates high temperatures without altering its properties.

As soon as the lower disc has been destroyed, the particles in the powder material will no longer be closed in the narrow space of the plug and they will be permitted to mutually move. The powder material will thereby flow down into the well. The upper disc (if it still is intact) will no longer be able to withstand the pressure from above and will break down. The well is thereby quickly and safely opened by the plug.

The invention claimed is:

1. A plug for installation in a well, the plug comprising:

a housing;

at least two discs carried by the housing and comprising a brittle material that can be fractured by mechanical forces;

a core disposed between the at least two discs and comprising a particulate material that is not soluble in water or hydrocarbons, wherein particles of the particulate material are packed to an extent that the particles are not allowed to move in relation to each other as long as the at least two discs are intact; and a trigger device with a point that is set up to break up at least one disc of the at least two discs by penetrating into the at least one disc, wherein the trigger device comprises a screw that is set up to rotate during the penetrating into the at least one disc.

2. The plug according to claim 1, wherein the screw is in contact with a channel for hydraulic liquid and a pressurization of the channel activates the screw.

3. The plug according to claim 2, wherein the trigger device comprises a piston with threads that correspond to threads on the screw so that activation of the piston rotates the screw as well as pushing the screw in towards the at least one of the discs of the at least two discs.

4. The plug according to claim 1, wherein the trigger device works at an angle towards a side of the at least one disc of the at least two discs that faces towards the core.

5. The plug according to claim 1, wherein the particulate material comprises at least one of sand, glass, and metal.

6. The plug according to claim 1, wherein the particulate material comprises an incompressible material.

* * * * *